US010179666B2

(12) United States Patent
Cain

(10) Patent No.: US 10,179,666 B2
(45) Date of Patent: Jan. 15, 2019

(54) PACKAGING MACHINE WITH PHASED SPLIT-PITCH BARREL LOADER

(71) Applicant: Graphic Packaging International, Inc., Atlanta, GA (US)

(72) Inventor: David Harrison Cain, Austell, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 568 days.

(21) Appl. No.: 14/865,367

(22) Filed: Sep. 25, 2015

(65) Prior Publication Data

US 2016/0009430 A1 Jan. 14, 2016

Related U.S. Application Data

(62) Division of application No. 12/643,307, filed on Dec. 21, 2009, now Pat. No. 9,174,753.

(60) Provisional application No. 61/203,841, filed on Dec. 29, 2008.

(51) Int. Cl.

| | |
|---|---|
| ***B65B 59/00*** | (2006.01) |
| ***B65B 35/20*** | (2006.01) |
| ***B65B 35/40*** | (2006.01) |
| ***B65B 5/06*** | (2006.01) |
| ***B65B 35/52*** | (2006.01) |
| ***B65B 43/52*** | (2006.01) |

(Continued)

(52) U.S. Cl.

CPC ..... *B65B 35/40* (2013.01); *B65B 5/06* (2013.01); *B65B 35/405* (2013.01); *B65B 35/44* (2013.01); *B65B 35/52* (2013.01); *B65B 43/52* (2013.01); *B65B 59/00* (2013.01); *B65B 59/02* (2013.01)

(58) Field of Classification Search

CPC ..... B65B 35/40; B65B 35/44; B65B 59/005; B65B 35/20

USPC ..... 53/473, 247

See application file for complete search history.

(56) References Cited

U.S. PATENT DOCUMENTS

| | | | |
|---|---|---|---|
| 4,718,540 | A | 1/1988 | Greenwell |
| 4,843,797 | A | 7/1989 | Butterly et al. |
| 5,036,644 | A | 8/1991 | Lashyro et al. |

(Continued)

FOREIGN PATENT DOCUMENTS

| | | | |
|---|---|---|---|
| EP | 0 717 702 | B1 | 12/1998 |

OTHER PUBLICATIONS

International Search Report arid Written Opinion for PCT/US2009/068954 dated Jul. 28, 2010.

(Continued)

*Primary Examiner* — Gloria R Weeks

(74) *Attorney, Agent, or Firm* — Womble Bond Dickinson (US) LLP

(57) ABSTRACT

A barrel loader for a carton packaging machine for packaging articles, including a leading pusher arm assembly and a trailing pusher arm assembly, the pusher arm assemblies positioned adjacent to a carton conveyor that move along a longitudinal path and cooperate to push an article group into a carton. Each pusher arm assembly has a pusher arm that carries a face on one end and also is extendable and retractable on guide rails transverse to the longitudinal path. The pusher arm assemblies are driven in a downstream direction along the longitudinal path by endless chains. One of the endless chains can be advanced or retarded in phase relative to the other endless chain to move the loader arms and associated faces further apart or closer together parallel to the longitudinal.

15 Claims, 13 Drawing Sheets

(51) Int. Cl.
*B65B 59/02* (2006.01)
*B65B 35/44* (2006.01)

(56) References Cited

U.S. PATENT DOCUMENTS

| | | | |
|---|---|---|---|
| 5,241,806 | A | 9/1993 | Ziegler et al. |
| 5,328,021 | A | 7/1994 | Calvert et al. |
| 5,355,658 | A | 10/1994 | Thiede |
| 5,553,441 | A | 9/1996 | Ivansco et al. |
| 5,560,473 | A | 10/1996 | Ivancso et al. |
| 5,727,365 | A | 3/1998 | Lashyro et al. |
| 5,758,474 | A | 6/1998 | Ziegler |
| 5,896,728 | A | 4/1999 | Domino et al. |
| 6,105,338 | A | 8/2000 | Kalany et al. |
| 6,308,502 | B1 | 10/2001 | Olson et al. |
| 6,711,878 | B1 | 3/2004 | Paselsky et al. |
| 6,912,826 | B2 | 7/2005 | Momich |
| 7,240,467 | B2 | 7/2007 | Moncrief et al. |
| 9,174,753 | B2 | 11/2015 | Cain |
| 2008/0209867 | A1 | 9/2008 | Lidington |

OTHER PUBLICATIONS

Supplementary European Search Report for EP 09 83 6988 dated Nov. 24, 2014.

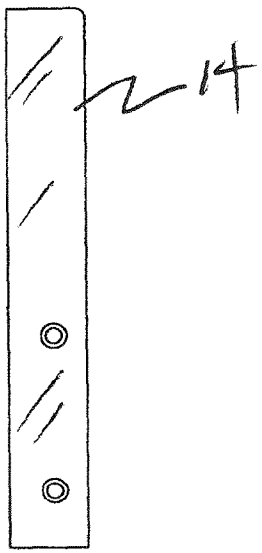
FIG 10
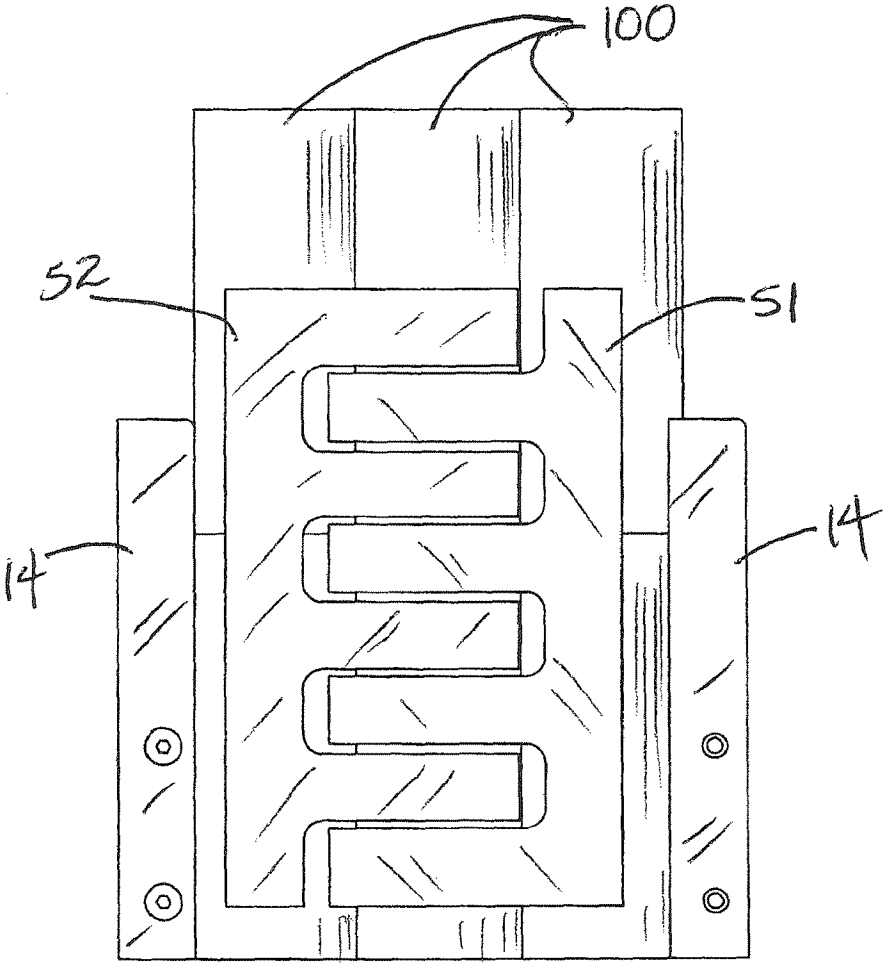

PACKAGING MACHINE WITH PHASED SPLIT-PITCH BARREL LOADER

CROSS-REFERENCE TO RELATED APPLICATIONS

This application is a divisional application of U.S. patent application Ser. No. 12/643,307, filed Dec. 21, 2009, which claims the benefit of U.S. Provisional Patent Application No. 61/203,841, filed Dec. 29, 2008.

INCORPORATION BY REFERENCE

The disclosures of U.S. patent application Ser. No. 12/643,307, which was filed Dec. 21, 2009, and U.S. Provisional Patent Application No. 61/203,841, which was filed on Dec. 29, 2008, are hereby incorporated by reference for all purposes as if presented herein in their entirety.

TECHNICAL FIELD

This disclosure relates generally to high speed continuous motion article packaging machines for packaging articles such as, for example, beverage cans, into paperboard cartons, and more specifically to barrel loaders of such packaging machines.

BACKGROUND

Article packaging machines that arrange articles, such as food and beverage cans and bottles, into groups of desired sizes and configurations, and place those article groups into paperboard or corrugated board cartons, are well known. In some types of packaging machines, the packaging operations may be performed simultaneously, while in others they may be performed sequentially, enabling the packaging of article groups into cartons at rates of hundreds of cartons per minute. It is not uncommon, for example, for packaging machines to operate at production rates of two hundred cartons per minute to three hundred cartons per minute, and higher. Packaging machines utilize a variety of techniques to group articles to be packaged depending generally on the type of machine and the kind of carton used. Some machines, for instance, place articles into a sleeve-type carton, usually by forming the sleeve from a carton blank, grouping the articles, and pushing or sliding each group of articles into an open sleeve, which is then closed at each end. Other machines may place basket-type cartons over an article group, and then close the carton along its bottom side to complete the packaging operation. Still other machines may form articles into groups, and then wrap a paperboard carton blank around each group of articles to form a completed package. These wrap-type cartons can include features that allow the opposed ends of the carton to cooperate to form a locking mechanism that holds the wrap-type carton together around each group of articles. Glue or other chemicals can be used to bind carton surfaces to one another in any type of carton, either alone or in conjunction with mechanical carton locking features, such as tabs and slots.

When packaging articles such as soft drink and beer cans into cartons, it sometimes is desirable to group the articles in two layers within the carton, with an upper layer of upright articles overlying a lower layer of upright articles. It is common to separate the layers with a paperboard divider pad on which the upper layer rests. Such a packaging configuration is sometimes referred to as "twin layer packaging." Packaging machines for obtaining twin layer packaging of articles are known, one such machine being exemplified in U.S. Pat. No. 5,758,474 of Ziegler, which is commonly owned by the assignee of the present application and hereby incorporated fully by reference. Such packaging machines generally may comprise an infeed assembly that progressively directs articles in groups into the selector bays of a synchronously moving selector flight. The infeed assembly includes an upstream infeed belt and associated infeed lanes for directing the bottom layer of articles into the bays. A separate downstream infeed belt and associated infeed lanes, which may be disposed at an elevated level relative to the upstream infeed belt and lanes, progressively directs the top layer of articles into the selector bays atop the already loaded bottom layer of articles. The articles thus are staged in two overlying layers in the selector bays and subsequently are pushed with a pusher assembly, sometimes referred to as a "barrel loader," into a waiting open carton on an adjacent and synchronously moving carton flight. The cartons are then closed to complete the packaging process.

Another example of a twin layer packaging machine is disclosed in U.S. Pat. No. 8,074,430, also owned by the assignee of the present invention, the entire contents of which are hereby incorporated by reference. In this example, a lower layer of articles move from their infeed lanes into adjacent synchronously moving selector bays, which group them into a predetermined configuration. A fixed pusher rail then sweeps the lower layer of articles from the selector bays into aligned synchronously moving can bays, which frees the selector bays. A divider panel is placed atop the lower layer of articles in the can bays. An upper layer of articles are then moved from their infeed lanes into the freed selector bays, which, again, group the upper layer of articles into the same configuration as the lower layer of articles. The selector flight then ramps upwardly to an upper level, carrying the upper layers of articles upwardly to a position above the lower layers of articles in the can bays. Another fixed pusher rail then sweeps the elevated upper layer of articles into the adjacent can bays atop the lower layer of articles already staged therein. The articles are thus staged in twin layered groups within the can bays. Pusher rods of an adjacent pusher rod assembly or barrel loader then extend laterally to push the staged twin layer groups of articles into open cartons on an adjacent synchronously moving carton flight. The cartons are then closed to complete the packaging operation.

Barrel loaders of packaging machines such as those discussed above may take several forms. One type of barrel loader, exemplified in the aforementioned U.S. Pat. No. 5,758,474, generally comprises a pair of spaced apart chain flights that carry a plurality of loader arm assemblies. The loader arm assemblies are oriented transversely with respect to the downstream direction of the machine and are adjacent to and move in synchronization with selector bays or can bays (depending upon the type of twin layer packaging machine being used) containing grouped articles such as beverage cans. Open ended cartons move synchronously with the selector bays or can bays on the opposite side from the barrel loader. The loader arm assemblies include loader arms that are extendable on rods in a transverse direction toward the selector bays or can bays and the open cartons on their opposite sides. The loader arms have cam followers and the barrel loader includes cam surfaces that are angled with respect to the downstream direction of the packaging machine. As the loader arm assemblies are moved in a downstream direction by their chain flights, the cam followers of the loader arms engage the angled cam surfaces, which cause the loader arms to extend transversely. The loader arms have loader faces on their ends that are sized and configured to engage a group of cans or bottles in a selector bay or a can bay as the loader arm extends to push the group progressively from the selector bay or can bay into waiting open carton sleeves. When a loader arm is fully extended and has completed the transfer, retraction of the arm is initiated and it is carried around to the bottom flight of the chain, where its cam follower engages another angled cam surface to retract the loader arm to its home position as it moves back to the upstream end of the barrel loader for the next cycle.

A problem with prior art barrel loaders has been that they have not been easily changed over to be able to load articles such as beverage cans of different sizes, and/or different numbers or configurations. Such a change-over generally has required that the packaging machine be shut down, that current loader faces be removed from the loader arms, and that different loader faces configured for the new container size and/or configuration be attached to the loader arms. Alternatively, an array of attachments and/or extenders may attach to the loader faces to reconfigure the faces for a different container configuration. This process is time consuming, results in excessive machine down time, and is subject to human error. There exists a need for an improved barrel loader that overcomes these and other problems and it is to the provision of such a barrel loader, and a packaging machine including such a barrel loader, that the present disclosure is primarily directed.

SUMMARY

Briefly described, a high speed continuous motion packaging machine with improved barrel loader is disclosed. In the preferred and illustrated embodiment, the packaging machine is a twin layer packaging machine of the second example discussed above and thus has a can flight between the selector bays and the carton flight, wherein twin layers of grouped articles are staged. It should be understood, however, that the barrel loader of this invention is not limited to such packaging machines, and may be applied to virtually any type of packaging machine where groups of articles are pushed into waiting cartons.

The barrel loader comprises a top pair of spaced chain tracks and a bottom pair of spaced chain tracks that support the flights of four endless chains. A first corresponding pair of inner chain flights is carried along the insides of the chain tracks and a second corresponding pair of outer chain flights is carried along the outsides of the chain tracks. The chains of the outer flights extend around and are driven by synchronous outer sprockets and the chains of the inner flight extend around and are driven by synchronous inner sprockets. The outer and inner sprockets are driven at the same rate of rotation to move the inner and outer upper chain flights in a downstream direction along the top chain track at the same speed. However, the inner sprockets are driven through a phasing gear box allowing the inner sprockets to be advanced or retarded by a desired phase angle relative to the outer sprockets. As a consequence, the positions of the inner chain flights are also advanced or retarded relative to the outer chain flights. In other words, the phase of the inside chain flights relative to the phase of the outside chain flights is selectively adjustable by adjusting the phasing gear box.

Transversely extending loader arm assemblies are secured at spaced intervals to the chains and carried thereby in a downstream direction along the upper chain tracks (and in an upstream return direction along the lower chain tracks). Each loader arm assembly includes a first loader arm and an adjacent and parallel second loader arm extending transversely relative to the chain flights and the downstream direction of the machine. The first loader arm is slidably mounted on rods that are attached to and carried by the inner chain flights and the second loader arm is slidably mounted on rods that are attached to and carried by the outer chain flights. The first and second loader arms of each loader arm assembly are thus extendable and retractable in a transverse direction relative to the chain tracks and the downstream direction.

The first and second loader arms carry cam followers that engage angled cam surfaces of the barrel loader to cause the first and second loader arms to extend progressively from a retracted or home position to a fully extended position as they move along the top chain tracks in a downstream direction. The cam followers engage other cam surfaces as they are returned along the bottom chain track to cause the loader arms to be retracted back to their home positions before moving back around to the upper chain track for the next cycle.

The ends of each loader arm of a loader arm assembly are provided with a corresponding loader face and the loader faces are generally comb-shaped with facing teeth that interleave when the loader faces are brought together. The loader faces thus may be said to be overlapping. During a packaging operation, the loader arms of each assembly extend as they move in a downstream direction so that their loader faces engage and push grouped articles from adjacent can bays (or selector bays depending upon the machine) into synchronously moving cartons on an oppositely adjacent carton flight.

To adjust the barrel loader to accommodate different size containers or containers grouped in different configurations, an operator need only adjust the phasing gear box to advance or retard the inner chain flight by a desired amount. This causes the loader arms of each loader arm assembly to move closer together or further apart, which, in turn, moves the loader faces of the arms closer together or further apart. The combined or composite surface area profile of the loader faces can thus be widened to engage and push wider groups of articles and narrowed to engage and push narrower groups of articles, all with a simple and rapid phase adjustment of the phasing gear box. The loader faces may also be moved significantly apart so that each loader face pushes a separate group of containers in separate selector bays. This is referred to as a "split-pitch" configuration. A split-pitch configuration of the loader faces may require some manual adjustment of the loader arm assemblies and/or the packaging machine since the loader faces are moved further apart while the dividers that define the selector bays are moved closer together. In other words, for split-pitch operation, the loader faces and the dividers are not phased together in the same direction, which is the normal automated phasing operation of the machine. However, with the exception of the split-pitch configuration, an operator is not required to shut down the packaging machine for extended periods, as has been the case in the past, to change over the machine for different packaging operations involving different groupings and/or sizes and/or configurations of articles being packaged.

Thus, a unique packaging machine with phased split-pitch barrel loader is disclosed that possesses distinct attributes and represents distinct improvements over the prior art. These and other aspects, features, and advantages of the barrel loader of this disclosure will be better appreciated upon review of the detailed description set forth below when taken in conjunction with the accompanying drawing figures, which are briefly described as follows.

BRIEF DESCRIPTION OF THE D WINGS

FIGS. 9-13 illustrate various possible spacings of the loader faces resulting from corresponding phasings of the loader arm assemblies for differing sizes and grouping configurations of articles being pushed from selector bays into cartons.

DETAILED DESCRIPTION

Figure 1:
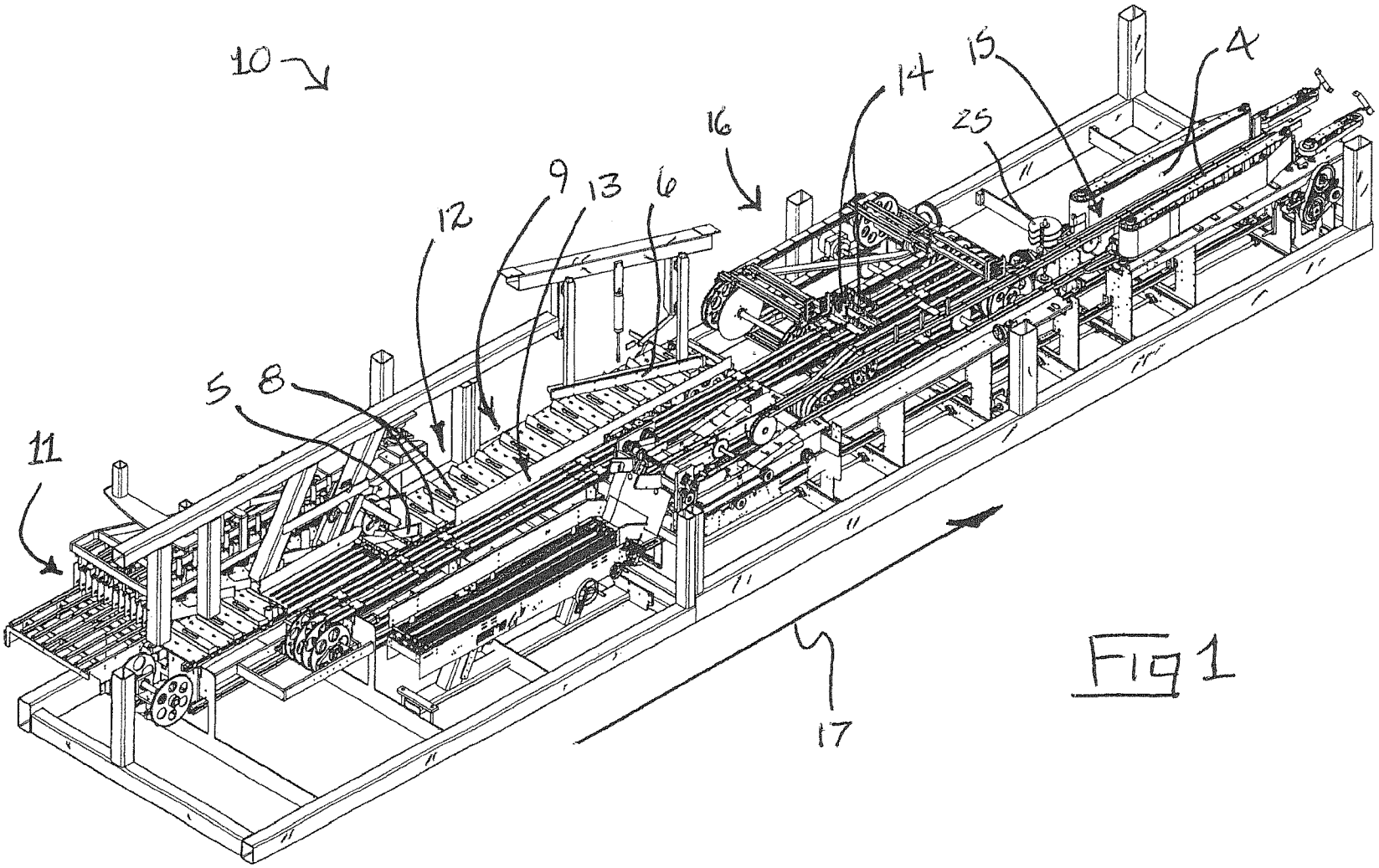
FIG. 1 is a perspective view of a high speed continuous article packaging machine that includes a phased split-pitch barrel loader according to this disclosure.

Referring now in more detail to the drawings, wherein like reference numerals indicate like parts throughout the several views, FIG. 1 depicts an exemplary high speed continuous motion packaging machine, in this case a beverage can packaging machine, that includes a barrel loader according to the present disclosure. The beverage can packaging machine of the illustrated embodiment is a twin layer packaging machine of the type having a ramped selector flight and adjacent can bays for the staging of layers of article groups, as discussed in more detail above. The invention is not limited to this particular type of packaging machine, but may be incorporated within other types of packaging machines. In general, the exemplary packaging machine 10 has a frame that supports an infeed section 11 having an infeed table and infeed lanes defined between upstanding guide rails. The infeed lanes align beverage cans and move them progressively at an angle relative to the downstream direction toward a selector section 12 of the machine. The selector section 12 includes a moving selector flight carrying spaced selector wedges 8 that force the beverage cans into groups of a predetermined number and configuration in selector bays between the selector wedges.

In the packaging machine illustrated in FIG. 1, a lower layer of grouped articles are arranged in the selector bays and swept by a fixed pusher rail 5 into corresponding and synchronously moving can bays between spaced dividers 14 (only one of which is shown in FIG. 1 for clarity) moving along a can flight 13. This frees the selector bays so that they can be loaded with an upper layer of grouped articles from the infeed section. When so loaded, the selector flight moves upwardly along a ramped section 9 of the selector flight to move the articles to a position above the tops of the lower layer of grouped articles already disposed in the adjacent can bays. The upper layer of grouped articles are then swept by a fixed pusher rail 6 into an adjacent synchronously moving can bay on the can flight 13 so that they are positioned atop or stacked on the lower layer of grouped articles. This "twin layer" of grouped articles in each can bay are thus staged to be moved into a corresponding open carton sleeve CT (FIG. 3) being carried along the adjacent synchronously moving carton flight 15.

The grouped articles are moved along the can flight in a downstream direction 17 toward a downstream end of the machine. The carton flight 15 carrying open ended cartons CT (FIG. 3) also moves in a downstream direction synchronously with the can flight and with each carton aligned with a twin layered group of articles on the can flight. A funnel 40 may be disposed between the can flight 13 and the carton flight 15 if desired to support cans when they move from the can flight into cartons on the carton flight.

A barrel loader 16 constructed and operating according to the present disclosure is disposed at the downstream end portion of the machine adjacent the can flight on the opposite side from the carton flight. The barrel loader, which is described in greater detail below, has a plurality of loader arm assemblies each having loader arms carrying loader faces that move synchronously and in transverse alignment with the grouped articles in the selector bays on the can flight. As the loader arms move downstream, they are extended by cam surfaces and cam followers to push corresponding groups of cans laterally off of the can flight and into a waiting open carton on the oppositely adjacent carton flight. A closer 25, further downstream, closes the ends of the packaged cartons, and the loader arms are retracted and returned to the upstream end of the barrel loader for another cycle.

Figure 2:
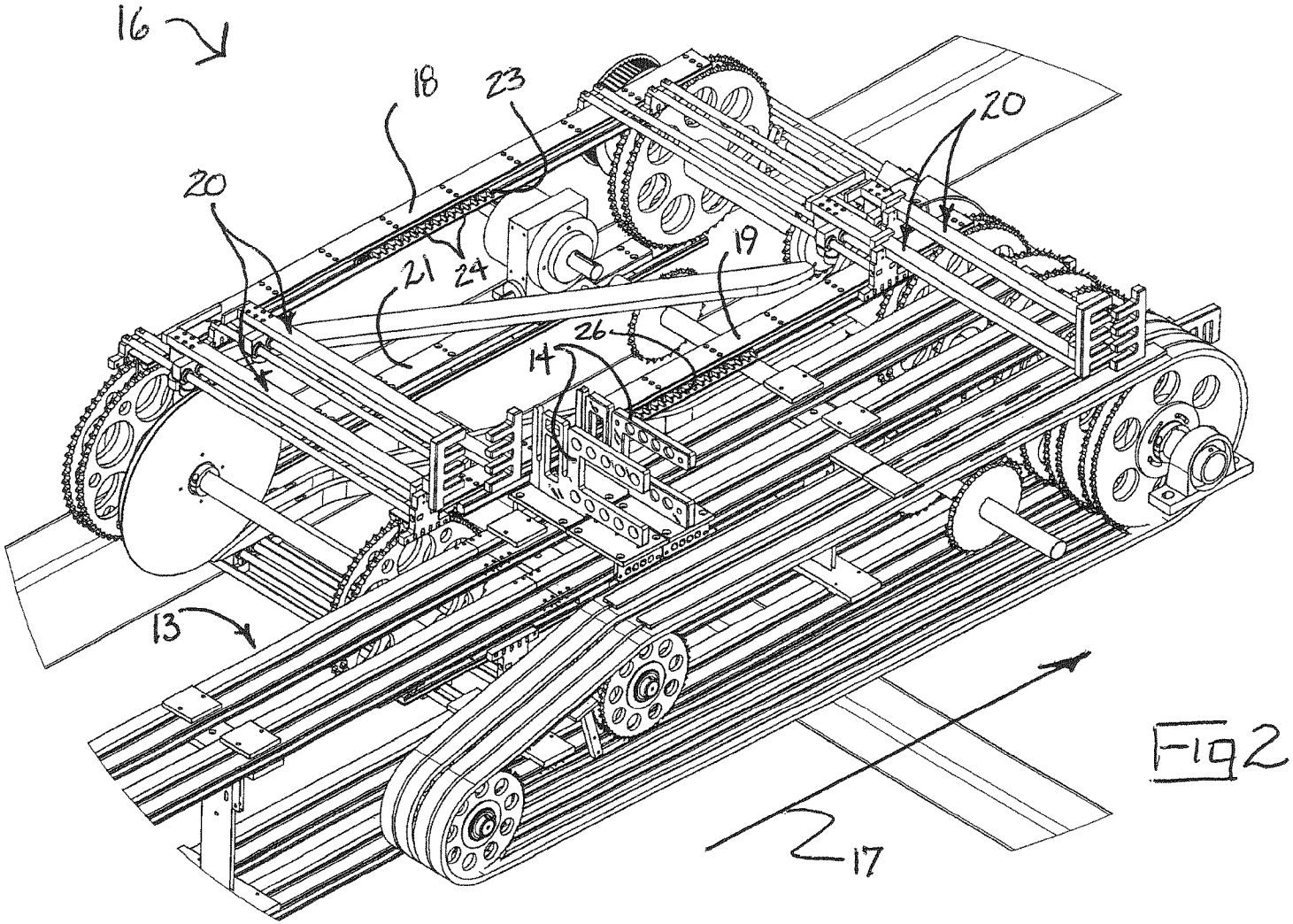
FIG. 2 is an enlarged perspective of the barrel loader portion of the packaging machine depicted in FIG. 1.

FIG. 2 is an enlarged view of the barrel loader 16 shown adjacent to a can flight 13 carrying dividers 14 (only two of which are shown here) between which beverage cans have previously been grouped in an upstream operation as described above. While only one pair of dividers defining one can bay is shown for clarity in FIG. 2, it will be understood that the can flight carries a plurality of spaced apart dividers defining between them a corresponding plurality of can bays into which twin layers of grouped cans are staged. Some of the loader arm assemblies, generally indicated at 20, are shown in various positions along the path of the barrel loader. Again, while only a few loader arm assemblies are depicted for clarity in FIG. 2, it will be understood that there is a loader arm assembly corresponding to and transversely aligned with each can bay of the can flight. Loader arms at the upstream end of the barrel loader are shown in FIG. 2 in their retracted positions, in which the loader faces reside adjacent a group of beverage cans (not shown) in a corresponding can bay on the can flight 13. Loader arms at the downstream end of the barrel loader are shown in their extended positions as they are configured just after having pushed a group of beverage cans from an adjacent can bay into a waiting open carton on the carton flight. Also shown in FIG. 2 are upper chain tracks 18 and 19 and lower chain tracks 21 and 22. Inner chains 23 (only one of which is visible) ride along the insides of the upper chain tracks and are provided with pins 24 for purposes described in more detail below. Outer chains 26 (one of which is visible) ride along the outsides of the upper chain tracks and are provided with corresponding pins 27.

Figure 3:
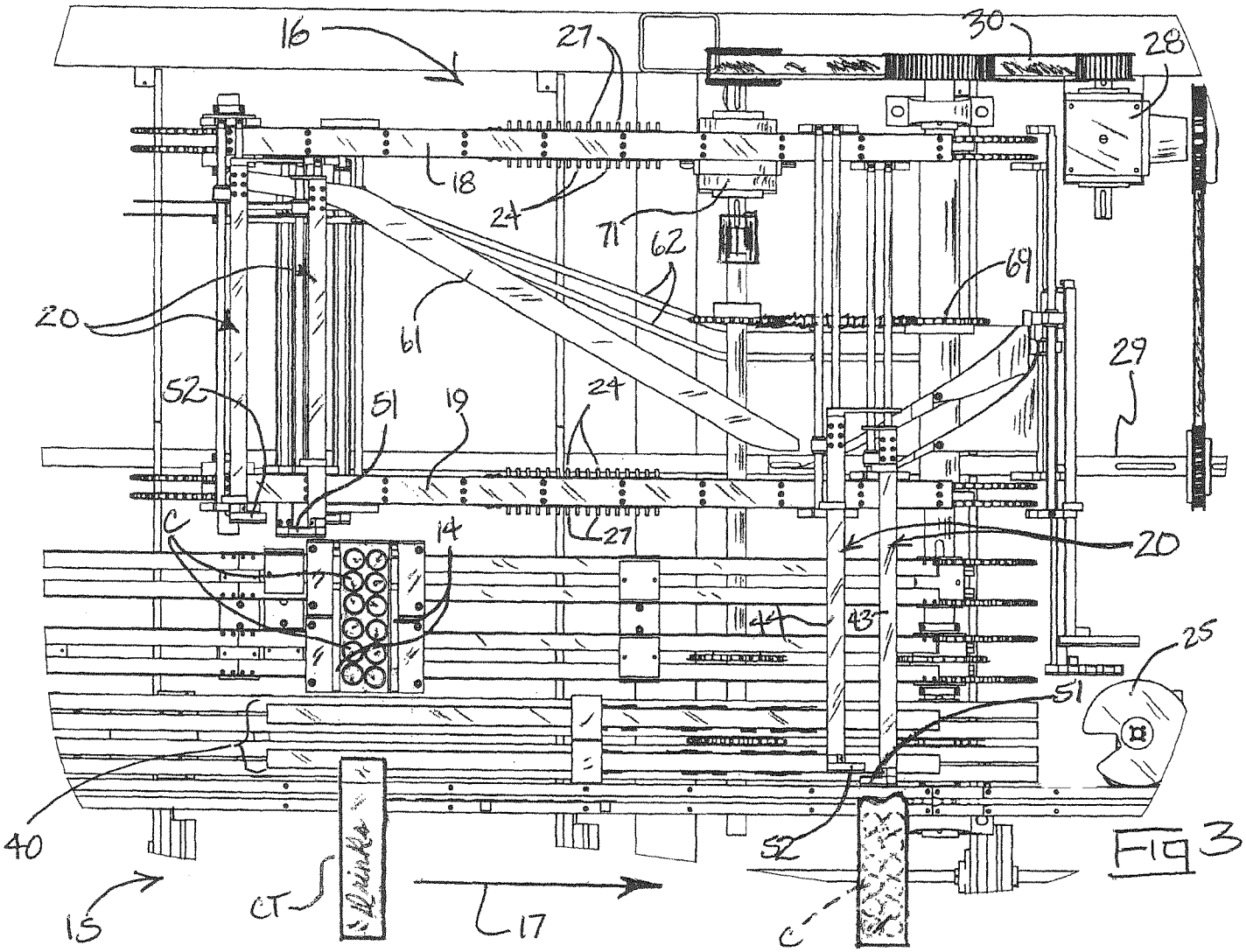
FIG. 3 is a top plan view of the barrel loader portion of the packaging machine depicted in FIG. 1.

FIG. 3 is a top plan view of the barrel loader 16 of FIG. 2 adjacent to can flight 13, which, in turn, is adjacent to carton flight 15. Grouped twin layer beverage cans C are disposed between dividers 14 on the can track, only one set of dividers and group of cans being shown in FIG. 3 for clarity. Cartons CT are disposed on the carton flight 15 and are aligned with respective can groups in can bays on the can track and move synchronously therewith in the downstream direction. Only two cartons CT are shown in FIG. 3 for clarity, but it will be understood that the carton flight carries a plurality of side-by-side cartons, each transversely aligned with a corresponding can bay on the can flight 13. An open end of the cartons CT faces adjacent can groups in corresponding can bays so that the can groups can be pushed from the can bays into the adjacent open cartons during the loading process. A closer assembly 25 closes the ends of the cartons after can groups have been loaded therein.

The twin layer can groups are loaded into the cartons by loader arm assemblies generally indicated at 20 in FIG. 3. The loader arms 43 and 44 of a loader arm assembly 20 are illustrated in their retracted positions at the upstream end of the barrel loader 16 in FIG. 3. In this position, the loader faces 51 and 52 secured to the ends of the loader arms 43 and 44 are positioned next to and move synchronously with a group of cans in a corresponding adjacent can bay. As the can bays, cartons, and loader arm assemblies are conveyed synchronously in the downstream direction, an upper cam surface 61 engages the cam follower of the trailing loader arm assembly (as detailed below) to cause the loader arms 43 and 44 and their loader faces to extend progressively through the adjacent can bay toward the open end of an oppositely adjacent carton CT to their fully extended positions, at the downstream end of the barrel loader. The extension of the loader arms pushes the group of cans C in the can bay laterally into the open carton CT to load the carton, the open end of which is subsequently closed at a downstream closer station, indicated generally at 25. The extended loader arms 43 and 44 then move around the downstream end of the barrel loader and are carried along the lower chain tracks back to the upstream end of the barrel loader for the next cycle. As they move back to the upstream end, they are progressively moved laterally back to their retracted positions by lower cam surfaces 62 upon which the cam followers of the loader assemblies ride.

The barrel loader 16 of the packaging machine 10 will now be described in greater detail with respect primarily to FIG. 4. The barrel loader 16 comprises a pair of spaced upper chain tracks 18 and 19 and a corresponding pair of spaced lower chain tracks 21 and 22 below the upper chain tracks. The chain tracks carry along their facing sides a pair of inner chains 23 having laterally projecting attachment pins 24 at each link of the chains. The chain tracks also carry along their opposite sides a pair of outer chains 26 having protruding attachment pins 27 projecting laterally from each chain link. Only a short section of each chain and its associated attachment pins is illustrated in FIG. 4 for purposes of clarity; however, it will be understood that the inner and outer chains are configured as endless chains that extend along the entire lengths of the upper and lower chain tracks and around corresponding sprockets 31, 32, 34, and 36 at the ends of the tracks.

The outer chains 26 extend around and are driven by a pair of outer drive sprockets 31 at the downstream end of the barrel loader and also extend around corresponding outer idler sprockets 34 at the upstream end of the barrel loader. Similarly, the inner chains 23 extend around and are driven by a pair of inner drive sprockets 32 at the downstream end of the barrel loader and extend around corresponding inner idler sprockets 36 at the upstream end of the barrel loader. The outer drive sprockets 31 are driven by the main head shaft drive 29 (FIG. 3) of the packaging machine through a gearbox 28 and belt 30 to move the chain flights in synchronization with movement of other sections of the machine driven by the head shaft drive, such as the selector flight, the can flight, and carton flight.

The inner drive sprockets are driven through a phasing gear box 71 (FIG. 3) that is coupled to drive the inner drive sprockets through a drive sprocket 69 and corresponding drive chain. As described in more detail below, the phasing gear box can be adjusted to advance or retard the position or phase of the inner drive sprockets with respect to the outer drive sprockets. Thus, the phase of the inner chains 23 relative to the outer chains 26 can be advanced or retarded by appropriately adjusting the phasing gear box 71.

Figure 4:
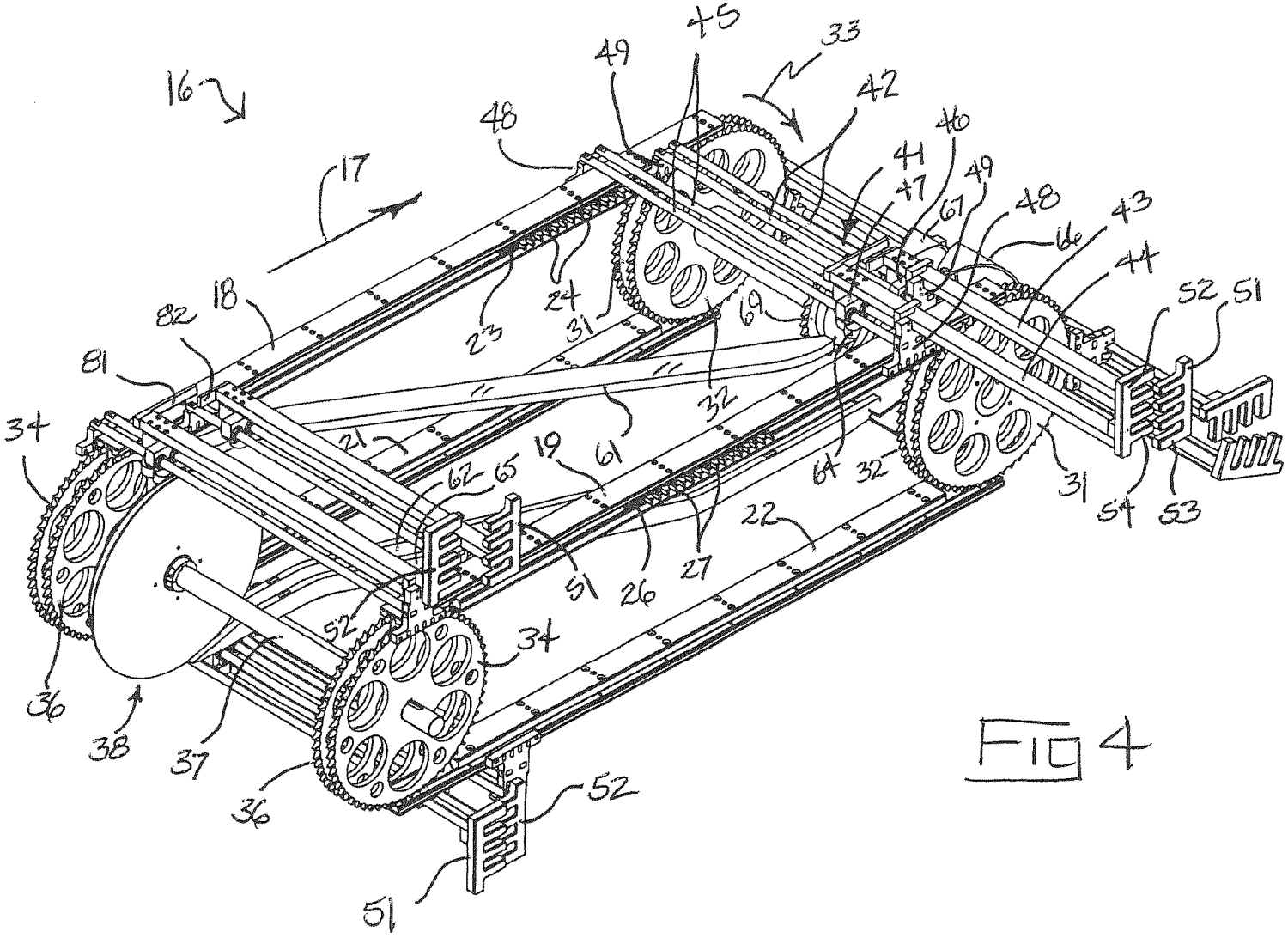
FIG. 4 is a top perspective view of a barrel loader constructed and functioning according to the present disclosure.

With continued reference to FIG. 4, a plurality of loader arm assemblies 41, only four of which are depicted in FIG. 4 for clarity, are secured to the inner and outer chains 23 and 26 via lug blocks 48 and 49, which are secured to pins 27 and 24 respectively on the outer and inner chains 26 and 23. As the chains are driven, they carry the loader arm assemblies in a downstream direction along upper chain tracks 18 and 19 and return them to the upstream end of the barrel loader along the lower chain tracks 21 and 22 in a continuous cycle. Each loader arm assembly 41 comprises a leading pair of guide rails 42 attached at their ends to the lug blocks 49, which fit on projecting attachment pins 24 of the inner chains. A trailing pair of guide rails 45 is attached at their ends to the outer lug blocks 48, which fit on projecting attachment pins 27 of the outer chains. The leading and trailing pairs of guide rails are thus moved along the upper chain tracks 18 and 19 in a the downstream direction 17 of the packaging machine by the chains to which they are attached which, in turn, are driven by outer and inner drive sprockets 31 and 32 respectively.

A leading loader arm 43 is slidably attached to the leading pair of guide rails 42 by a leading bushing block 47. Likewise, a trailing loader arm 44 is slidably attached to the trailing pair of guide rails 45 by a trailing bushing block 46. As the bushing blocks slide to the right along their respective guide rails in FIG. 4, the loader arms 43 and 44 are extended laterally with respect to the downstream direction of the packaging machine. Conversely, as the bushing blocks slide to the left in FIG. 4, the loader arms are retracted laterally relative to the downstream direction of the packaging machine. The loader arms of each loader arm assembly carry on their free ends a loader face, the leading loader arm carrying a leading loader face 51 and the trailing loader arm carrying a trailing loader face 52. The leading loader face 51 is formed with a set of spaced apart teeth 53 that extend toward the trailing loader face 52 and, likewise, the trailing loader face is formed with a set of spaced apart teeth 54 that extend toward the leading loader face 51. The teeth 53 and 54 are sized, spaced, and positioned so that, when the loader faces are brought closer together, their teeth interleave or overlap with each other, as perhaps best illustrated in FIG. 10, to form a combined loader face profile with a width that is variable depending upon the distance between the leading and trailing loader arms and their loader faces.

The leading bushing block 46 carries a depending cam follower 63 (FIG. 8) and the trailing bushing block 47 carries a depending cam follower 64. The cam follower 64 of the trailing bushing block depends downwardly to a position below the cam follower 63 of the leading bushing block when the bushing blocks are moving along the upper chain tracks. An upper cam surface 61 extends at an angle from a position adjacent the upstream end of the loader 16 to a position adjacent the downstream end of the loader as illustrated. The cam surface 61 is positioned so that the cam follower 64 of the trailing bushing block of each loader arm assembly engages and rides along the cam surface 61 as the loader arm assemblies move from the upstream end to the downstream end of the loader. The cam follower 63 of the leading bushing block does not engage the upper cam surface 61 but instead is positioned above the level of the upper cam surface 61.

The riding of the cam follower 64 along the cam surface 61 causes the trailing loader arm 44 to extend laterally as it is moved along in the downstream direction by the chains 26. As the trailing loader arm begins to be extended, a push bar or plate 81 on its back end engages a strike plate 82 on the back end of the leading loader arm 43. This occurs at the point where the loader faces 51 and 52 of the arms are aligned with each other to form a combined loader face profile. Continued lateral extension of trailing loader arm 44, then, causes the leading loader arm 43 to be extended at the same rate as the trailing loader arm 44 as a consequence of the push plate 81 pushing on the strike plate 82. As both loader arms extend laterally, their loader faces engage twin layer grouped beverage cans between dividers of the can flight and push them progressively into adjacent synchronously moving cartons on the carton flight, as described above.

At the downstream end of the loader 16, the extended loader arms are carried by their chains around the downstream sprockets. As the loader arm assemblies move around the sprockets, the depending cam follower of the trailing loader arm first engages a trailing arm cam guide 67, which retracts the trailing loader arm slightly until its loader face 52 is displaced behind the loader face 51 of the leading loader arm. Then, the depending cam follower of the leading loader arm engages leading arm cam guide 66, which begins to retract the leading loader arm. Since the loader faces have been displaced from each other, they are able to traverse the circular path around the sprockets without jamming or interfering with each other.

When the loader arms have traversed the downstream sprockets, they are carried on their chains back to the upstream end of the loader along the lower chain tracks 21 and 22. During this return trip, the loader arms of each loader arm assembly are retracted back to their fully retracted positions in preparation for the next loading cycle. This is accomplished with lower cam surfaces 62 and 65, which engage and guide the cam followers of the trailing and leading loader arms. More specifically, as the loader arm assemblies are carried back along the bottom chain tracks, the cam followers of their loader arms engage the cam surfaces 62 and 65, which cause the loader arms to be progressively retracted back to their fully retracted positions. At the upstream end of the barrel loader 16, the loader arms are carried around the idler sprockets back to the upper chain guides for the next cycle. As the loader arms traverse the sprockets, they are maintained in their fully retracted positions with their loader faces displaced from each other by cam guide discs 38, which engage the cam followers as the loader arms move back into position for another cycle. It will be noted that the cam guide discs 38 are of different diameters to accommodate the cam followers of the loader arm assemblies, which project different distances from their respective bushing blocks.

As discussed in more detail below, the barrel loader 16 of this disclosure is adjustable to accommodate beverage cans or other articles of differing sizes and grouping configurations without the use of change parts. Such adjustment is accomplished either by advancing or retarding or, in other words, phasing, the inner chains 23 relative to the outer chains 26 by appropriate adjustment of the phasing gear box 71, which drives the inner drive sprockets 32. Since the leading loader arm of each loader arm assembly is attached to and carried by the inner chains 23, and the trailing loader arm is attached to and carried by the outer chains 26, advancing the phase of the inner chains 23 relative to the outer chains 26 moves the loader arms of each assembly further apart. Conversely, retarding the phase of the inner chains 23 relative to the outer chains 26 moves the loader arms of each assembly closer together. As the loader arms move closer together, their loader faces also move closer together and the teeth of the loader faces interleave or overlap to allow this relative movement of the loader faces. The loader faces thus together form a combined loader face surface profile with a composite area that is variable and adjustable as a function of the spacing between the loader arms of the loader assemblies (see, for example, FIGS. 9-13). The loader arms also may be phased sufficiently far apart to separate the loader faces of each loader arm completely from each other in a "split-pitch" configuration of the barrel loader, as discussed in more detail below.

Preferably, when the barrel loader is installed as part of a packaging machine, such as that illustrated in FIG. 1, the main head shaft drive of the machine that drives the selector flight, the can flight, and the carton flight also is coupled to and drives the outer drive sprockets 31 of the barrel loader. Thus, the outer chains 26 and therefore the trailing loader arms are moved synchronously with the can flight and carton flight. Also, the mechanisms of the can flight and the carton flight that allow them to be phased and thereby adjusted to accommodate beverage can groups of differing size and/or configuration also are driven through the phasing gear box 71 that drives the inner drive sprockets 32 of the barrel loader. In this way, a single adjustment of the phasing gear box simultaneously adjusts the can flight, the carton flight, and the loader face surface area of the barrel loader for a new beverage can size or grouping configuration. More specifically, advancing the phase of the phasing gear box widens the space between the dividers of the can flight, widens the space between the flight lugs of the carton flight, and widens the loader arms and their loader faces to accommodate a wider can size or a wider configuration of can groups. Conversely, retarding the phase of the phasing gear box narrows the space between dividers, narrows the space between carton flight lugs, and narrows the space between loader arms and their loader faces to accommodate a narrower can size or a narrower configuration of can groups. It will thus be seen that adjusting the entire packaging machine for different sizes and/or grouping configurations of beverage cans or other articles becomes a matter of adjusting the phase of the phasing gear box 71.

Figure 5:
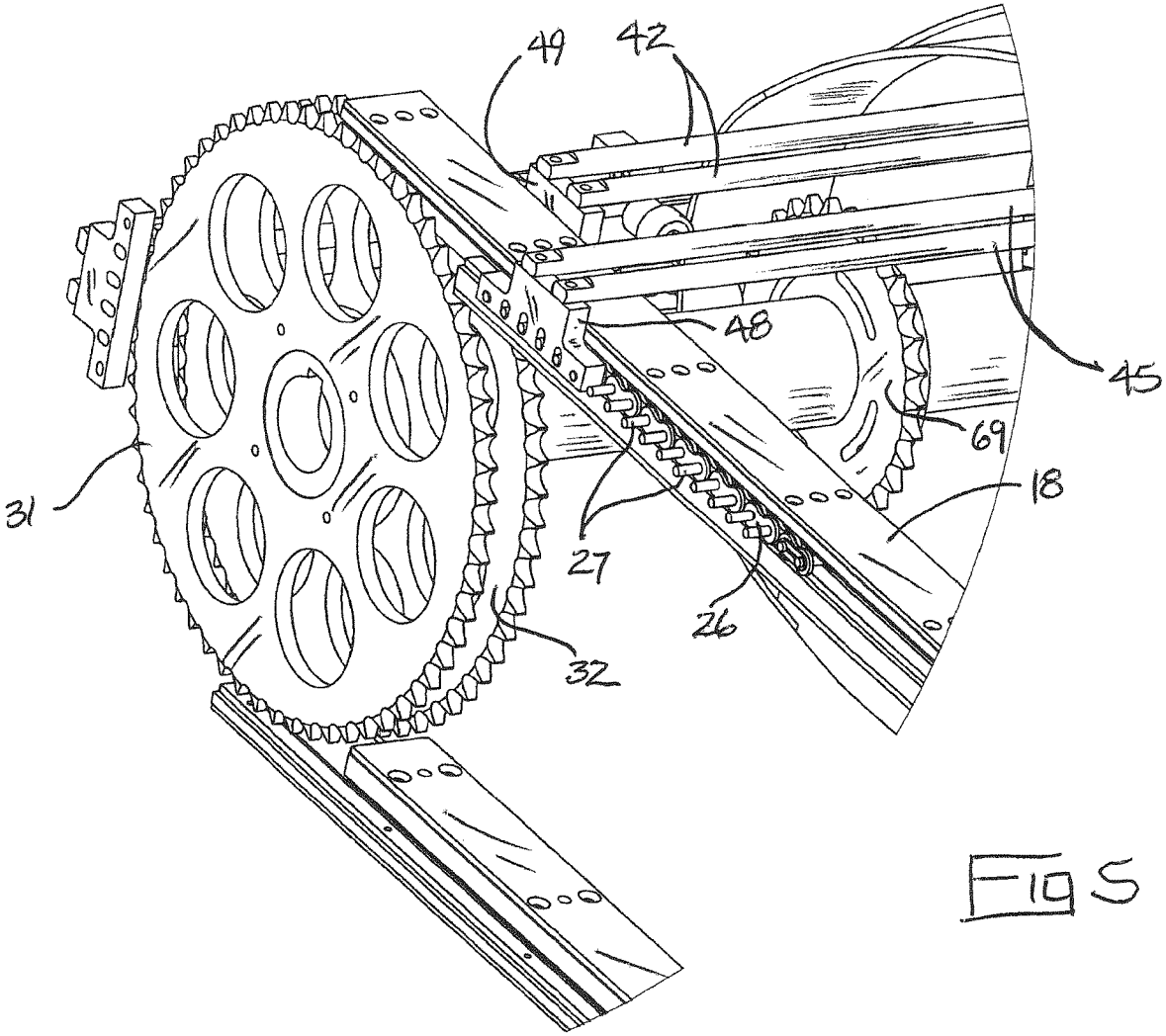
FIG. 5 is an enlarged perspective view of a portion of the downstream end portion of the barrel loader.

FIG. 5 is an enlarged view that shows clearly the outer drive sprocket 31, the inner drive sprocket 32, and the lug blocks 48 and 49 with which the leading guide rails 42 and trailing guide rails 45 are attached to their chains. A portion of the outer chain 26 with its projecting attachment pins 27 is shown and illustrates how the lug blocks are attached to their respective chains with the holes of the lug blocks receiving corresponding pins of the chain. With this mounting structure, the guide rails can easily be positioned at different locations and distances apart on the chains if desired. Of course, the chains extend in a continuous loop along the upper and lower chain tracks and around corresponding sprockets at the upstream and downstream ends of the barrel loader. Only a section of chain is shown in FIG. 5 for clarity.

Figure 6:
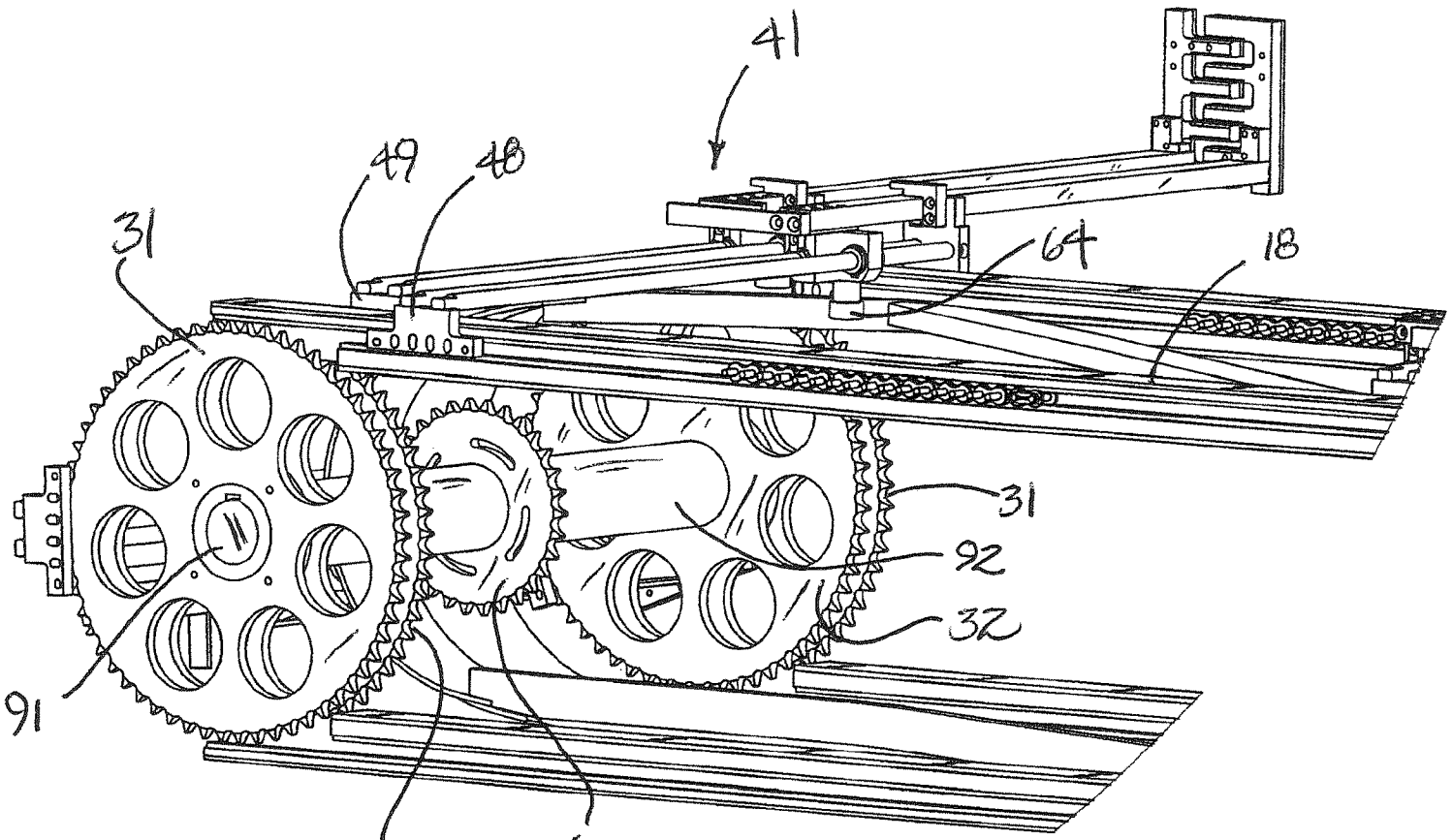
FIG. 6 is a less enlarged perspective view of the downstream end portion of the barrel loader illustrating the phased drive shaft.

FIG. 6 illustrates the phasing drive shaft assembly of the barrel loader. Specifically, outer drive sprockets 31 are mounted on a shaft 91 that, in operation, is coupled to the main head drive of the packaging machine (see FIG. 3). Inner drive sprockets are mounted on a shaft 92 that is outwardly concentric and rotatable with respect to the shaft 91, which extends through the shaft 92. The shaft 92 is driven through drive sprocket 69 by a corresponding chain coupled to the phasing gear box 71 (FIG. 3), which also is driven by the main head drive. When the phasing gear box is adjusted, the angular relationship between the shaft 91 and the shaft 92 changes and the angular relationship and phase of the inner drive sprockets relative to the outer sprockets is consequently changed. In turn, the relative phase of the inner chains and the outer chains and thus the spacing between the loader arms of the loader arm assemblies is correspondingly adjusted as a result of the relative displacements of the inner chains relative to the outer chains.

Figure 7:
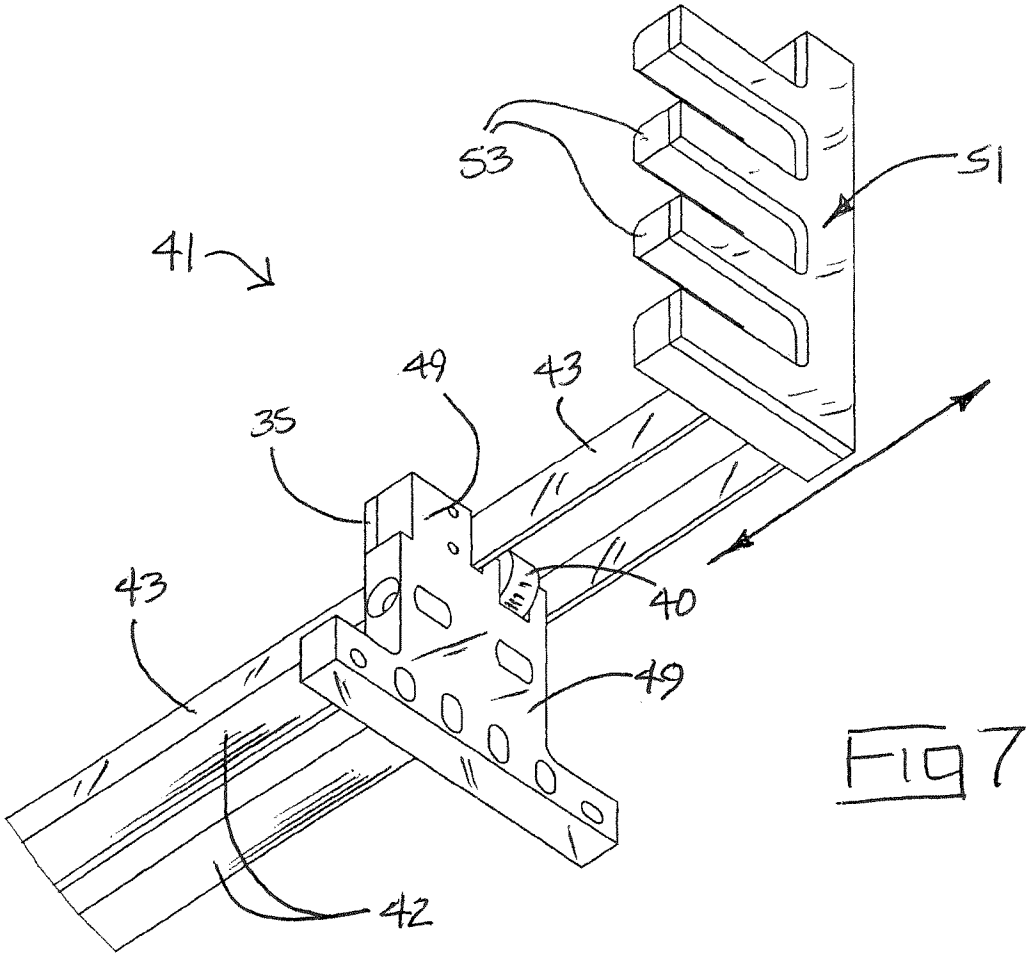
FIG. 7 is an enlarged perspective view showing the forward end portion of a leading loader arm assembly and its loader face according to the disclosure.
Figure 8:
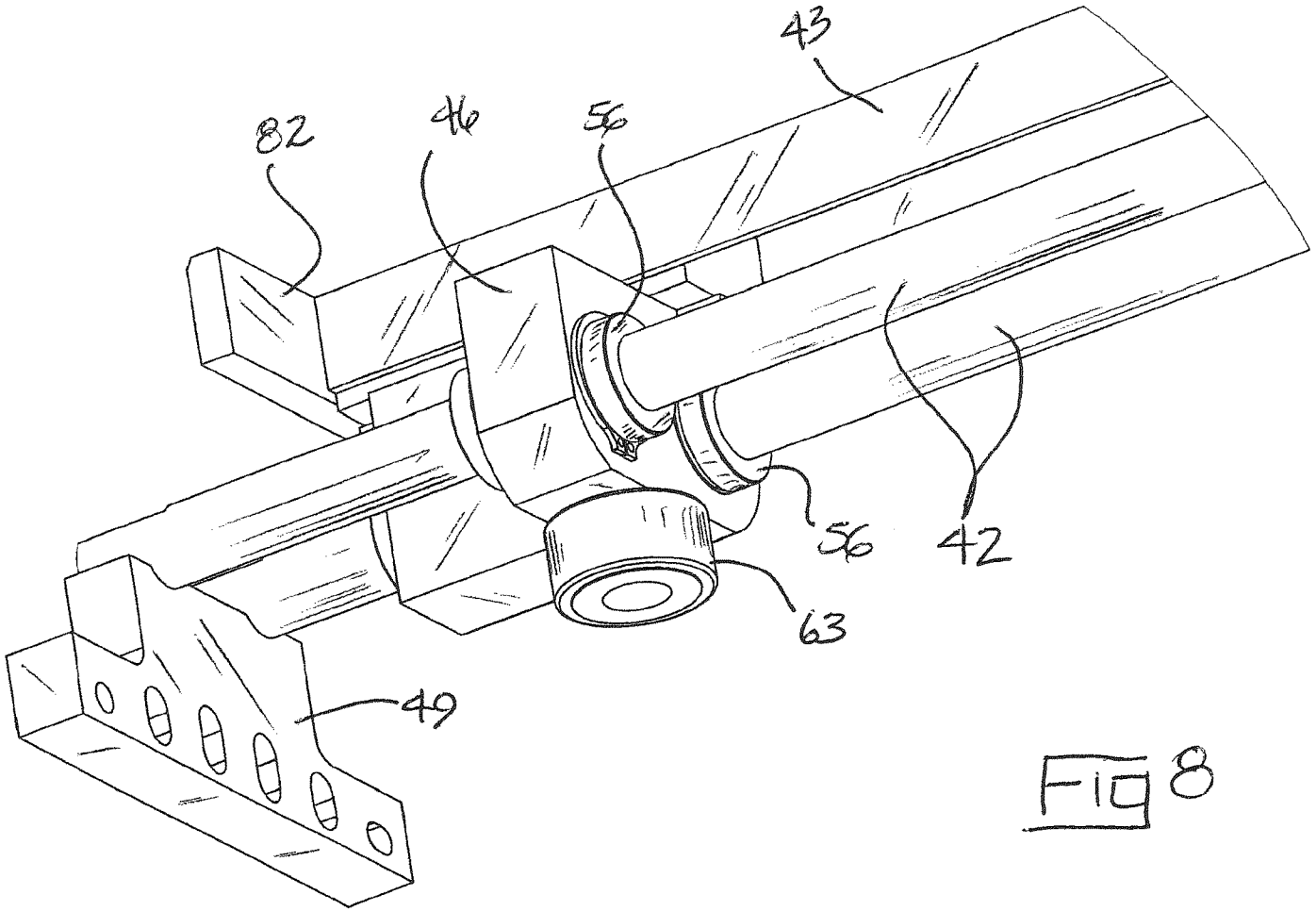
FIG. 8 is an enlarged perspective view showing the rear end portion of the loader arm assembly of FIG. 8 illustrating the bushing block, cam follower, and strike bar.

FIGS. 7 and 8 illustrate details of the leading loader assembly 41 that carries leading loader arm 43. Referring to both of these figures simultaneously, the leading loader arm 43 preferably, but not necessarily, is formed with a generally inverted U shape. Leading loader face 51 is secured with screws or other appropriate fasteners to the forward end of the loader arm 43 and is configured with teeth 53 as discussed above. The underside of the loader arm 43 rests and rides on a roller bearing 40 that is rotatably secured to the inside lug block 49, which, in turn, is attached to an inner chain with the attachment pins of the chains extending through the holes along the lower edge of the lug block 49. Thus, as the loader arm 43 extends in or out as indicated by the double headed arrow in FIG. 7, it moves with little friction over the lug block 49 by virtue of the roller bearing 40. A retainer 35 is attached to the lug block 49 and includes a finger (visible in FIG. 3) that extends over the top of the loader arm 43 to prevent the loader arm from jumping the track as it rides on the roller bearing 40.

Referring to FIG. 8, the rear end portion of the loader arm 43 is attached with screws or other appropriate fasteners to a bushing block 46. The bushing block 46 is provided with a pair of bushings 56 that ride along the guide rails 42 as the loader arm is extended and retracted. Cam follower 63 depends from the bushing block and, as described above, functions to engage the cam guide 66 and lower cam surface 62 to retract the leading loader arm as it moves around the downstream sprockets and back along the underside of the barrel loader to its upstream end. Strike bar 82 is secured to the extreme rear end of the loader bar 43 and, as also described above, is sized and positioned to be engaged by the push bar 81 on the rear end of the trailing loader arm to extend the push bars and their push faces out simultaneously and aligned to push cans from the can flight into waiting cartons on the carton flight. The trailing loader arm of each loader arm assembly is configured and operates substantially the same as the leading loader arm illustrated in FIGS. 7 and 8.

Figure 9:
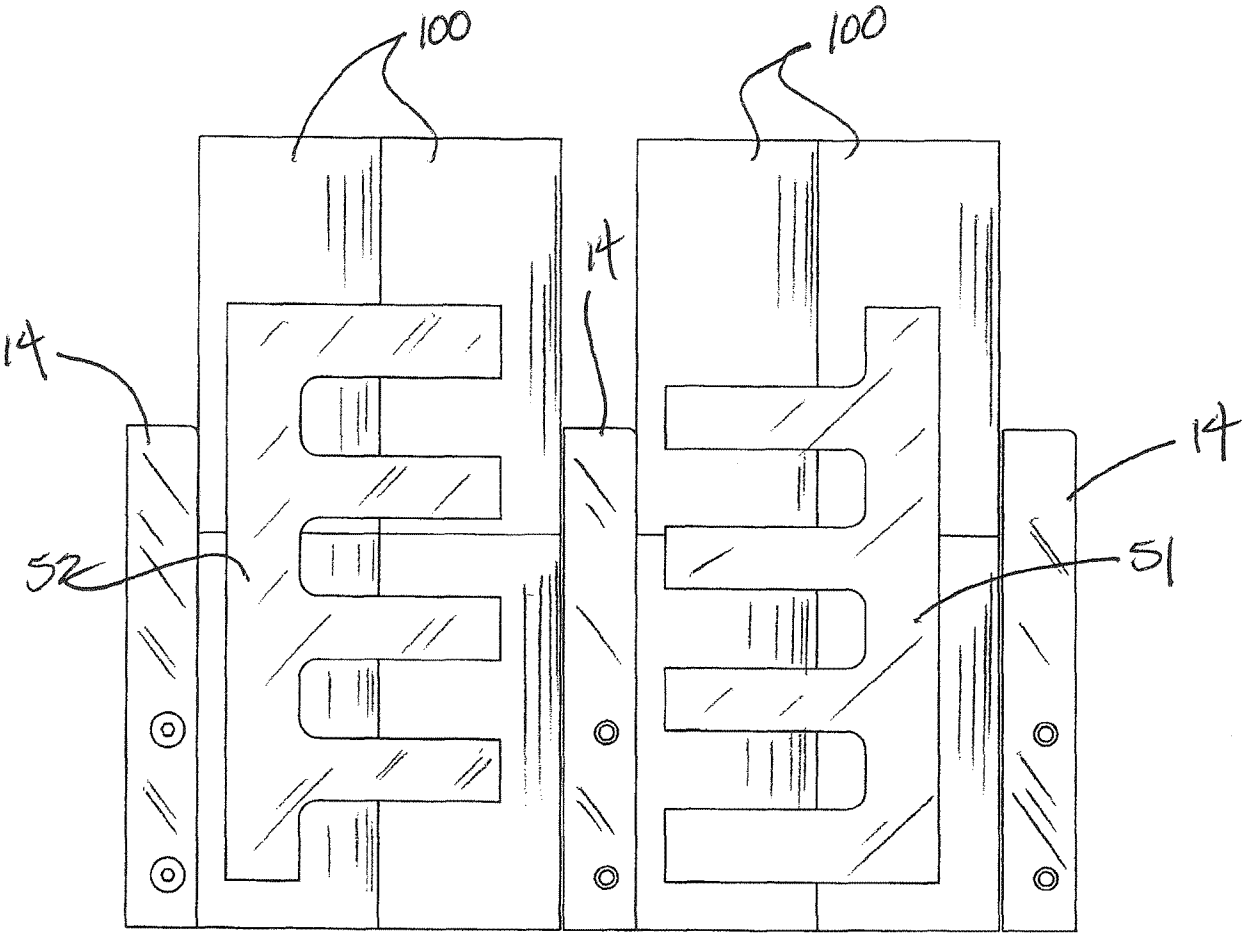

FIGS. 9-13 illustrate various possible spacings of the loader faces for pushing groups of articles, in this case beverage cans 100, of various sizes and group configurations from can bays between the dividers of the can flight into adjacent cartons on the carton flight. More specifically, FIG. 9 illustrates a split pitch configuration of the loader faces 51 and 52 for loading two adjacent groups of cans 100 in separate side-by-side can bays between dividers 14 on the can flight. In this configuration, the loader faces 51 and 52 are separated entirely from each other and each loader face pushes a separate group of beverage cans between separate dividers 14 from the can flight. As mentioned above, the split-pitch configuration may require manual adjustments in positioning of the loader arms and/or the dividers between can bays since they are not phased in the same direction. More specifically, for the split pitch configuration, the dividers of the can bays are adjusted toward one another to be closer together while the loader arms and their faces are adjusted further apart to be further away from each other.

Figure 11:
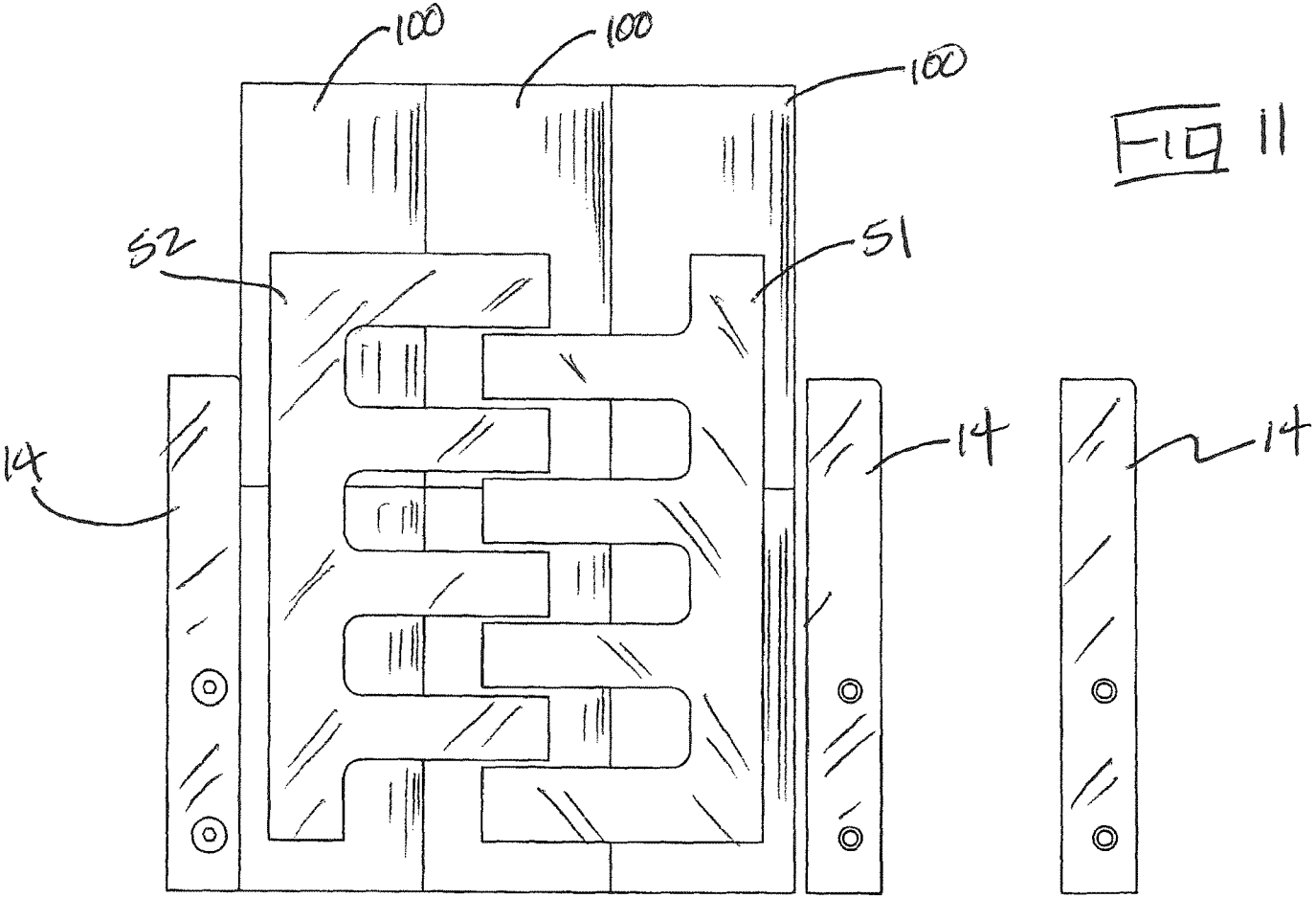
Figure 12:
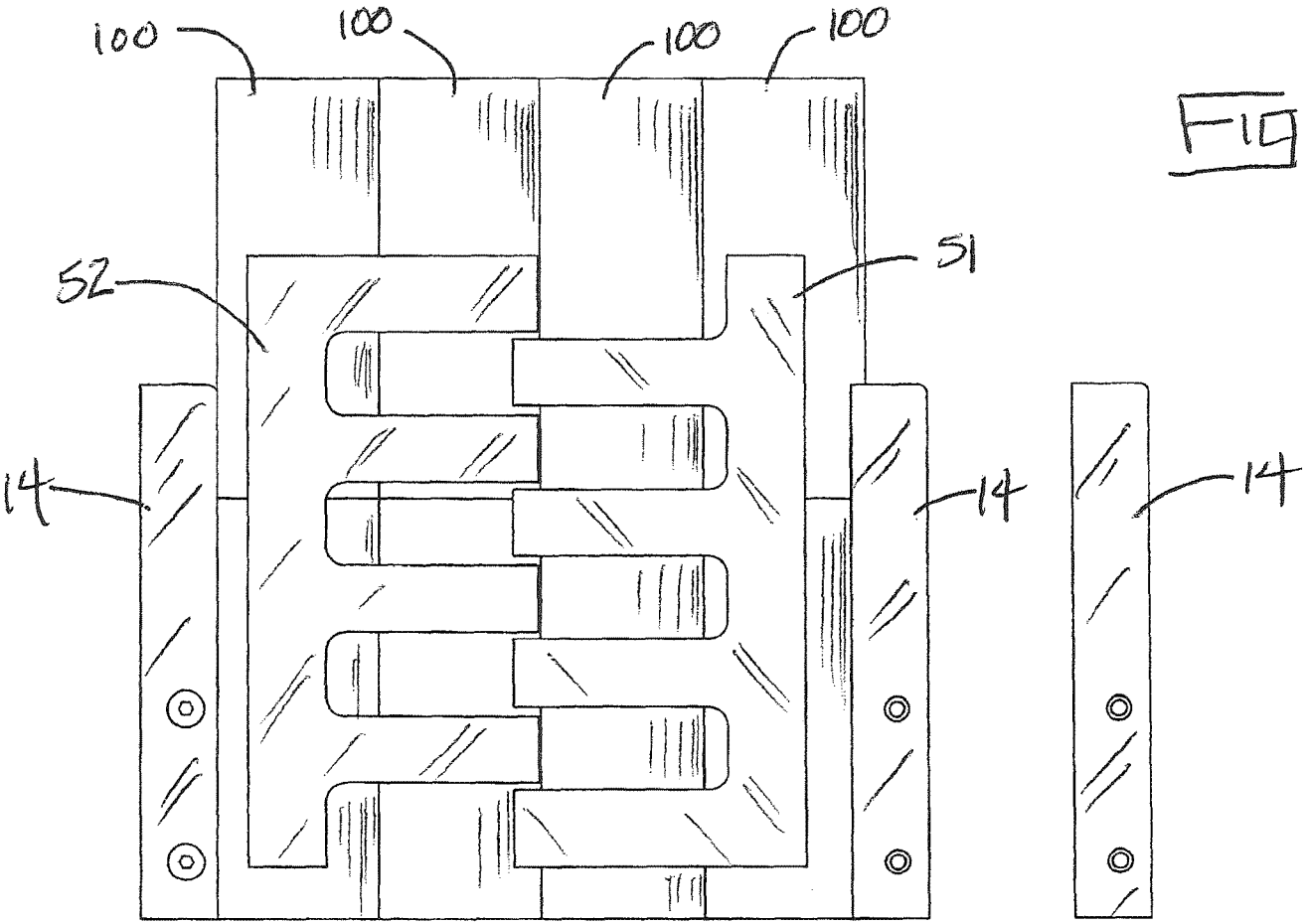
Figure 13:
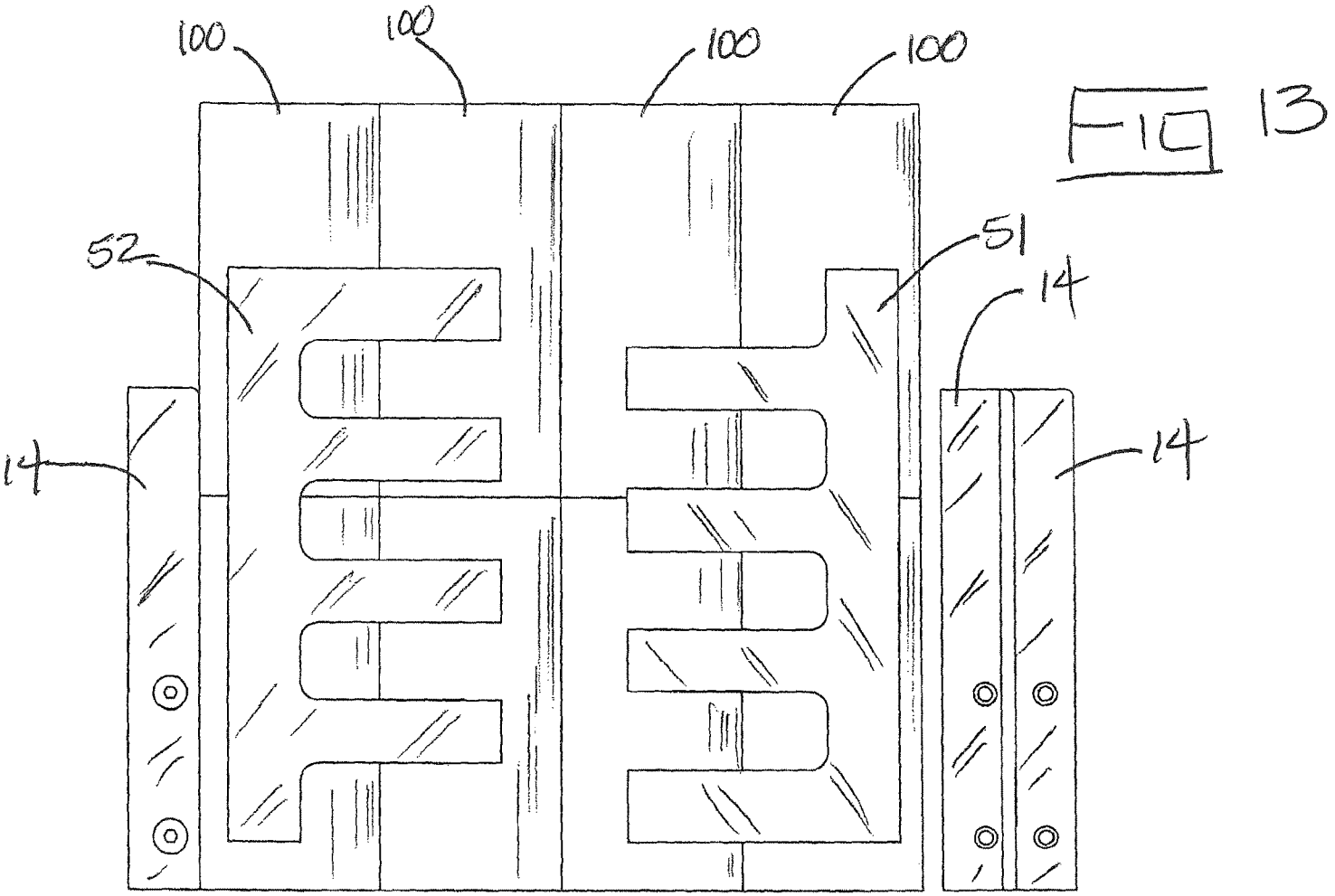

In FIG. 10, the loader faces 51 and 52 are close together with their fingers interleaved to form a composite loader face profile sized to push a group of smaller beverage cans in a 3×2 configuration from a can bay between dividers 14 into a waiting carton. FIG. 11 shows a configuration of the loader faces for pushing a 3×2 configuration of larger beverage cans wherein the loader faces are spaced farther apart with their fingers partially interleaved. FIG. 12 shows a configuration of the loader faces for pushing a group of smaller beverage cans arranged in a 4×2 configuration. Here, the loader faces are further apart still with their fingers still partially interleaved to form a composite pusher profile sized appropriately for the width of the group of cans to be pushed. Finally, FIG. 13 shows a configuration of the loader faces for pushing a group of larger beverage cans arranged in a 4×2 array. Here the loader faces are completely separated to form a composite loader face profile having an area appropriate for the width of the group of larger beverage cans. Of course, with the possible exception of the split pitch configuration, all of these and other configurations of the loader faces are obtained by appropriately advancing or retarding the inner chains 23 which, in turn, advances or retards the leading loader arm assembly relative to the trailing loader arm assembly. Further, since the phasing gear box may also drive the leading dividers of the can flight and the leading carton lugs of the carton flight, all of these components are widened or narrowed at the same time. Thus, a single phasing adjustment of the phasing gear box adjusts the packaging machine for loading virtually any size and configuration of containers into waiting cartons.

The invention has been described in terms of preferred embodiments and methodologies considered by the inventors to represent the best modes of carrying out the invention. A wide variety of additions and deletions to and variations of the illustrated embodiments might well be made by skilled artisans without departing from the spirit and scope of the invention as set forth in the claims.

What is claimed is:

1. In a continuous motion packaging machine for loading an article group into a carton, the packaging machine having a conveyor moving in a downstream direction along a longitudinal path and a barrel loader having first and second extendable pusher rods positioned along the conveyor for pushing the article group into a carton, a method of adjusting the composite profile of pusher faces of the barrel loader to correspond to the profile of the article group to be pushed, the method comprising the steps of:

(a) configuring the first and second pusher faces to interleave with each other as they are brought together toward one another along the longitudinal path of the conveyor, to define a composite pusher face profile;

(b) mounting the first and second pusher faces to the ends of the extendable pusher rods;

(c) varying the distance between the first and second extendable pusher rods along the path of the conveyor to bring the pusher faces toward or away from one another until the pusher faces define a composite profile of a predetermined size.

2. The method of claim 1 and wherein step (c) comprises mounting the first and second pusher rods to separate endless chains, driving the chains to move the first and second pusher rods in the downstream direction, and varying the phase of the endless chains relative to each other.

3. The method of claim 2 and further comprising extending the first and second pusher rods toward the conveyor as they move in the downstream direction for pushing adjacent articles with the pusher faces.

4. The method of claim 2 and further comprising varying the phase of the endless chains in the downstream direction relative to each other to selectively align the extendable pusher rods with the article group profile.

5. The method of claim 1 and wherein step (a) comprises forming the first and second pusher faces with fingers and slots, the fingers of the first pusher face configured to move into the slots of the second pusher face as the pusher faces are moved together.

6. In a continuous motion packaging machine for packaging article groups into cartons, the packaging machine having a conveyor moving in a downstream direction along a longitudinal path and also including an article loading assembly having pusher rods and associated pusher faces for placing a group of articles into a carton, a method of adjusting the pusher faces of the article loading assembly to correspond to the grouping configurations of the articles to be placed into the cartons, the method comprising the steps of:

(a) moving first and second pusher rods and the associated pusher faces in a direction parallel to the conveyor to define a predetermined composite pusher face profile;

(b) moving the pusher rods and associated pusher faces toward the conveyor to contact an article group with the pusher faces, and (c) moving the pusher rods and the associated pusher faces further toward the conveyor to place the article group into a carton.

7. The method of claim 6 and wherein in step (a) comprises mounting the first and second pusher rods to separate endless chains and driving the chains to move the first and second pusher rods in the downstream direction, and varying the phase of the endless chains relative to each other.

8. The method of claim 7 and wherein step (a) comprises extending the first and second pusher rods toward the conveyor as they move in the downstream direction for pushing adjacent articles with the pusher faces.

9. The method of claim 6 and wherein step (a) comprises forming the first and second pusher faces with fingers and slots, the fingers of the first pusher face member configured to move into the slots of the second pusher face member as the pusher face members are moved together.

10. The method of claim 6 and wherein step (a) comprises forming the first and second pusher faces with fingers and slots, the fingers of the first pusher face configured to move into the slots of the second pusher face as the pusher face members are moved together so that the fingers of the first pusher face are received into the slots of the second pusher face.

11. In a continuous motion packaging machine for packaging article groups comprising first article group layers and second article group layers into cartons, the packaging machine having a conveyor moving in a downstream direction along a longitudinal path and also including an article loading assembly having first and second pusher rods and associated pusher faces for placing the group of articles into a carton, a method of packaging the articles into the cartons, comprising the steps of:

(a) selecting the size and the configuration of the first article group and moving the first article group in the downstream direction;

(b) selecting the size and the configuration of the second article group and moving the second article group in the downstream direction;

(c) placing the second article group on top of the first article group;

(d) configuring the first and second pusher faces to interleave with each other as they are brought together toward one another parallel to the longitudinal path of the conveyor, to define a composite pusher face profile;

(e) mounting the first and second pusher faces to the ends of the extendable pusher rods; and (f) varying the distance between the first and second pusher rods parallel to the path of the conveyor to bring the pusher faces toward or away from one another until the pusher faces define a composite profile of a predetermined size.

12. The method of claim 11, and (g) pushing the articles in to the cartons by moving the pusher rods and pusher faces transversely to the longitudinal path to contact the articles and place the articles into the cartons.

13. The method of claim 11 and wherein step (f) comprises mounting the first and second pusher rods to separate endless chains, driving the chains to move the first and second pusher rods in the downstream direction, and varying the phase of the endless chains relative to each other.

14. The method of claim 11 and further comprising extending the first and second pusher rods toward the conveyor as they move in the downstream direction for pushing adjacent articles with the pusher faces.

15. The method of claim 1 and wherein step (a) comprises forming the first and second pusher faces with fingers and slots, the fingers of the first pusher face configured to move into the slots of the second pusher face as the pusher face members are moved together.

* * * * *